US009732917B2

(12) United States Patent
Sun et al.

(10) Patent No.: US 9,732,917 B2
(45) Date of Patent: Aug. 15, 2017

(54) OPTICAL ASSEMBLY AND OPTICAL MODULE

(71) Applicant: PlayNitride Inc., Tainan (TW)

(72) Inventors: Sheng-Yuan Sun, Tainan (TW); Po-Jen Su, Tainan (TW); Kuan-Yung Liao, Tainan (TW); Gwo-Jiun Sheu, Tainan (TW)

(73) Assignee: PlayNitride Inc., Tainan (TW)

( * ) Notice: Subject to any disclaimer, the term of this patent is extended or adjusted under 35 U.S.C. 154(b) by 52 days.

(21) Appl. No.: 14/737,498

(22) Filed: Jun. 12, 2015

(65) Prior Publication Data

US 2016/0018082 A1 Jan. 21, 2016

(30) Foreign Application Priority Data

Jul. 16, 2014 (TW) ..... 103124432 A

(51) Int. Cl.

| | |
|---|---|
| ***F21V 13/08*** | (2006.01) |
| ***F21K 99/00*** | (2016.01) |
| ***F21V 9/16*** | (2006.01) |
| ***F21K 9/62*** | (2016.01) |
| ***F21K 9/64*** | (2016.01) |
| *F21V 13/02* | (2006.01) |
| *F21Y 115/10* | (2016.01) |

(52) U.S. Cl.

CPC ..... *F21K 9/56* (2013.01); *F21K 9/62* (2016.08); *F21K 9/64* (2016.08); *F21V 9/16* (2013.01); *F21V 13/02* (2013.01); *F21Y 2115/10* (2016.08)

(58) Field of Classification Search

CPC ..... F21K 9/64; F21K 9/52

USPC ..... 362/84

See application file for complete search history.

(56) References Cited

U.S. PATENT DOCUMENTS

2012/0243203 A1* 9/2012 Koike ..... F21S 48/1241 362/19

2014/0264420 A1* 9/2014 Edwards ..... F21V 9/16 257/98

(Continued)

FOREIGN PATENT DOCUMENTS

| | | |
|---|---|---|
| TW | 200804720 | 1/2008 |
| TW | 201142214 | 12/2011 |

(Continued)

OTHER PUBLICATIONS

"Office Action of Taiwan Counterpart Application" , dated Apr. 26, 2016, p. 1-p. 11.

*Primary Examiner* — Karabi Guharay

(74) *Attorney, Agent, or Firm* — Jianq Chyun IP Office

(57) ABSTRACT

An optical assembly that is adapted to be located at a light path of light emitted from at least one light source and spaced apart from the at least one light source by a distance is provided. The optical assembly includes a wavelength converting device, which is a spatial structure, and a reflector. The reflector covers a portion of the wavelength converting device and exposes at least a portion of a region of at least one surface of the wavelength converting device. The light emitted from the at least one light source enters or leaves the wavelength converting device from at least the portion of area which is not covered by the reflector. An optical module including the light source and the optical assembly is further provided.

8 Claims, 4 Drawing Sheets

(56) References Cited

U.S. PATENT DOCUMENTS

| | | | | |
|---|---|---|---|---|
| 2014/0286037 | A1* | 9/2014 | Matsuba | F21K 9/52 362/553 |
| 2015/0252964 | A1* | 9/2015 | Takahashi | F21K 9/56 362/84 |
| 2016/0053949 | A1* | 2/2016 | Zehetner | F21K 9/56 362/84 |

FOREIGN PATENT DOCUMENTS

| | | |
|---|---|---|
| TW | M431286 | 6/2012 |
| TW | 201317518 | 5/2013 |
| TW | 201336109 | 9/2013 |
| TW | 201346187 | 11/2013 |
| TW | 201350754 | 12/2013 |
| TW | M480694 | 6/2014 |

* cited by examiner

OPTICAL ASSEMBLY AND OPTICAL MODULE

CROSS-REFERENCE TO RELATED APPLICATION

This application claims the priority benefit of Taiwan application serial no. 103124432, filed on Jul. 16, 2014. The entirety of the above-mentioned patent application is hereby incorporated by reference herein and made a part of this specification.

BACKGROUND OF THE INVENTION

Field of the Invention

The invention is related to an optical assembly and an optical module, and more particularly to an optical assembly and an optical module having wavelength converting and light redirecting functions.

Description of Related Art

Ever since Thomas Edison invented an incandescent lamp, electricity has been widely used worldwide for illumination. Now an illumination apparatus such as a fluorescent lamp with high luminance and durability has been further developed. Compared with an incandescent bulb, the fluorescent lamp has advantages of high efficiency and low operating temperature; however, the heavy metal (e.g. mercury) contained in the fluorescent lamp is likely to cause damage to the environment when being discarded as waste.

Along with the development of illumination technology, a light source, e.g. a solid state light emitting device lamp which is more power-saving and environmental, has been developed. A solid state light emitting device of the solid state light emitting device lamp is, for example, a light emitting diode. The light emitting diode emits light via combination of electrons and holes in a P-N junction. Compared with the incandescent lamp or the fluorescent lamp, the light emitting diode lamp has the following advantages, including low power consumption, high luminous efficiency, and long service life. In addition, the solid state light emitting device lamp does not require heavy metal such as mercury and therefore is more environmental. However, among all the conventional solid state light emitting device lamps, the display range of the light emitted by the solid state light emitting device is highly focused, and the conventional solid state light emitting device lamps provide a visual effect that is significantly different from conventional incandescent lamps.

SUMMARY OF THE INVENTION

The invention provides an optical assembly having wavelength converting and light redirecting functions.

The invention provides an optical module including the abovementioned optical assembly.

In the invention, an optical assembly is adaptable for being disposed at a light path of the light emitted by at least one light source and spaced apart from the at least one light source by a distance. The optical assembly includes a wavelength converting device and a reflector. The wavelength converting device is a spatial structure. The reflector covers a portion of the wavelength converting device and exposes at least a portion of a region of at least one surface of the wavelength converting device, wherein the light emitted by the at least one light source enters and leaves the wavelength converting device from the region of the wavelength converting device not being covered by the reflector.

In an embodiment of the invention, the shapes of the abovementioned spatial structure include a pyramid, a cone, a column, or a hemisphere.

In an embodiment of the invention, the at least one surface of the wavelength converting device not being covered by the reflector is a single surface; the light emitted by the at least one light source enters and leaves the wavelength converting device from the single surface of the wavelength converting device.

In an embodiment of the invention, the at least one surface of the wavelength converting device not being covered by the reflector includes at least two surfaces; the light emitted by the at least one light source enters and leaves the wavelength converting device respectively from the at least two surfaces of the wavelength converting device.

In an embodiment of the invention, the wavelength converting device is a block-shaped structure formed of a single crystalline material.

In an embodiment of the invention, the wavelength converting device is formed of a multi-crystalline material by bonding and sintering.

In an embodiment of the invention, the wavelength converting device is formed of a cured paste doped with phosphor.

In an embodiment of the invention, the reflector is a reflecting layer which is coated or adhered to a portion of the surface of the wavelength converting device.

In an embodiment of the invention, the reflector is a block-shaped structure. The wavelength converting device is embedded in the reflector and exposes at least a portion of the region of the at least one surface of the wavelength converting device.

In the invention, an optical module includes at least one light source and one optical assembly. The optical assembly is located at a light path of the light emitted by at least one light source and spaced apart from the at least one light source by a distance. The optical assembly includes a wavelength converting device and a reflector. The wavelength converting device is a spatial structure. The reflector covers a portion of the wavelength converting device and exposes at least a portion of the region of at least one surface of the wavelength converting device, wherein the light emitted by at least one light source enters and leaves the wavelength converting device from the region of the wavelength converting device not being covered by the reflector.

In an embodiment of the invention, the abovementioned light source is a laser light source.

Based on the above, in the invention, a designer may make the light emitted by the light source positioned outside the optical assembly to enter or leave the wavelength converting device from a specific portion of the wavelength converting device by choosing a wavelength converting device with a suitable shape and selecting which surface of the wavelength converting device is to be covered and exposed by the reflector, so as to achieve the effect of converting the wavelength of light and changing light profile.

In order to make the aforementioned features and advantages of the disclosure more comprehensible, embodiments accompanying figures are described in detail below.

DESCRIPTION OF EMBODIMENTS

Figure 1A:
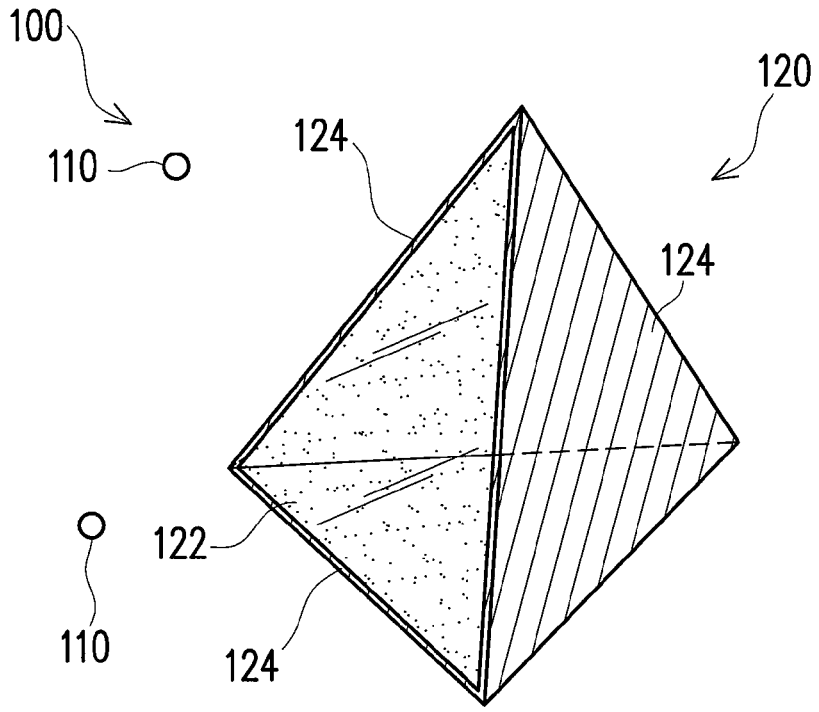
FIG. 1A is a schematic view illustrating an optical module according to an embodiment of the invention.
Figure 1B:
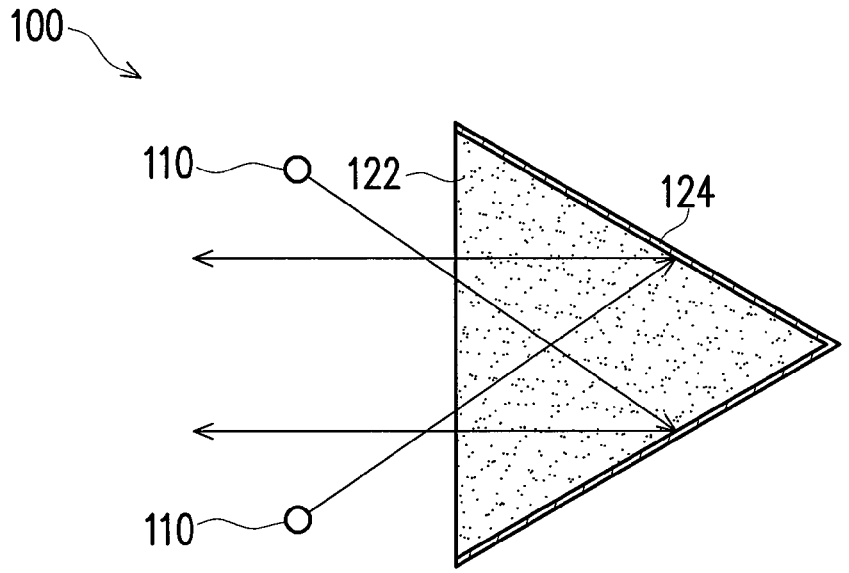
FIG. 1B is a schematic view illustrating the optical module of FIG. 1A from another viewing angle.

FIG. 1A is a schematic view illustrating an optical module according to an embodiment of the invention. FIG. 1B is a schematic view illustrating the optical module of FIG. 1A from another viewing angle. Please refer to FIGS. 1A and 1B. In the embodiment, an optical module 100 includes at least one light source 110 and an optical assembly 120. In the embodiment, the light source 110 is a laser light source which has stronger energy and focused light beam; meanwhile, two light sources 110 are illustrated as an example. However, in other embodiments, the light source 110 may be a light emitting diode, and the amount of the light source 110 may be one or more than three; the type of amount of the light source 110 are not limited thereto.

The optical assembly 120 includes a wavelength converting device 122 and a reflector 124. In the embodiment, the wavelength converting device 122 is a block-shaped structure formed of a single crystalline material which may be designed into a required shape thorough a dressing or cutting process. A substance that may convert wavelength is provided within the wavelength converting device 122, allowing a portion of the transmitted light to convert the wavelength while the other portion of the light remains to have the same wavelength. Therefore, the light that is transmitted thorough the wavelength converting device may emit a plurality of color light, and the light of different colors may be mixed to form white light.

Certainly, the type of the wavelength converting device 122 is not limited thereto. In other embodiments, the wavelength converting device 122 may be formed of a multi-crystalline material by bonding and sintering, or may be formed of a cured paste doped with phosphor. For example, the paste may be an epoxy material (for example, epoxy resin), thermoplastic acrylic resin, or silicone resin. The phosphor may be garnet phosphor, silicate phosphor, nitride phosphor, or oxy-nitride phosphor. The phosphor may also be yttrium aluminum garnet (YAG) phosphor, terbium aluminum garnet (TAG) phosphor, Eu-activated alkaline earth silicate phosphor, or sialon phosphor.

The wavelength converting device 122 is a spatial structure such as a pyramid. In the embodiment, the shape of the wavelength converting device 122 is shown as a tetrahedron (pyramid) as an example; however, in other embodiments, the shapes of the wavelength converting device 122 may also be other spatial structures such as a cone, a column or a hemisphere. The shapes of the wavelength converting device 122 may vary depending on needs and are not limited thereto.

The reflector 124 covers a portion of the wavelength converting device 122 and exposes at least a portion of the region of at least one surface of the wavelength converting device 122. In the embodiment, the reflector 124 is a reflecting layer. The reflecting layer may be formed of a high reflective material coated or printed on the wavelength converting device 122, or formed of a multi-layers film coated on the wavelength converting device 122. In addition, the reflector 124 may also be a reflecting sheet that is formed of metal. The reflector 124 covers a portion of the surface of the wavelength converting device 122 thorough adhesion.

As shown by FIG. 1A, the reflector 124 covers three surfaces and exposes one surface of the four surfaces of the wavelength converting device 122. The optical assembly 120 is located at the light path of the light emitted by the light source 110 and spaced apart from the light source 110 by a distance. As shown by FIG. 1B, the light emitted by the light source 110 may enter the wavelength converting device 122 from the surface of the wavelength converting device 120 not being covered by the reflector 124, and the light leaves the wavelength converting device 122 from the same surface after being reflected by the reflector 124. Therefore, in the embodiment, the wavelength converting device 122 of the optical assembly 120 may provide the function of converting the wavelength of light, and allow the light profile of the light that leaves the wavelength converting device 122 to be modified through disposing the reflector 124 at an appropriate position of the wavelength converting device 122.

Figure 2:
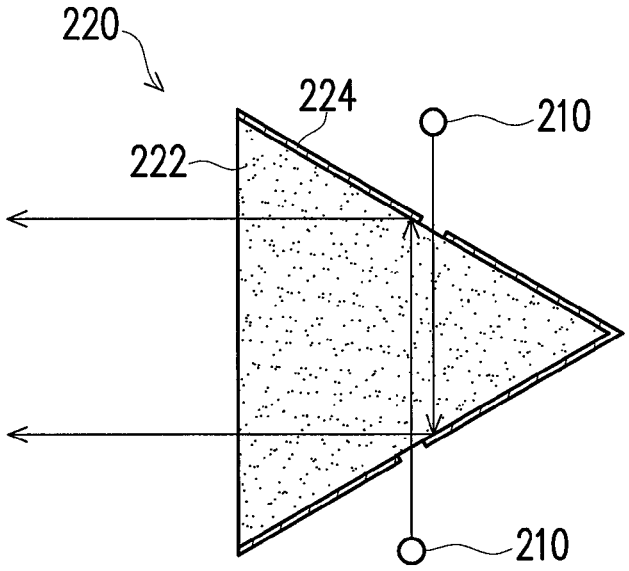
FIG. 2 is a schematic view illustrating an optical assembly according to another embodiment of the invention.

FIG. 2 is a schematic view illustrating an optical assembly according to another embodiment of the invention. Please refer to FIG. 2. The main difference between an optical assembly 220 in FIG. 2 and the optical assembly 120 of FIG. 1A lies in that the three surfaces of a wavelength converting device 222 of the optical assembly 220 of FIG. 2 are not totally covered by a reflector 224, more specifically, a partial region of each of the two surfaces of the wavelength converting device 222 is not covered by the reflector 224. The light emitted by the two light sources 210 respectively enter the wavelength converting device 222 from the regions of the two surfaces, and leave the wavelength converting device 222 from the surface which is not covered by the reflector 224 after being reflected by the reflector 224. In the embodiment, the light of the two light sources 210 leave the wavelength converting device 222 from the same surface; however, in other embodiments, the light of the two light sources 210 may leave the wavelength converting device 222 from different surfaces. Compared with FIG. 1B, in the embodiment, the relative positions of the light source 210 and the optical assembly 220 may be adjusted depending on needs, which may also achieve the effect of converting wavelength and changing light profile.

Figure 3:
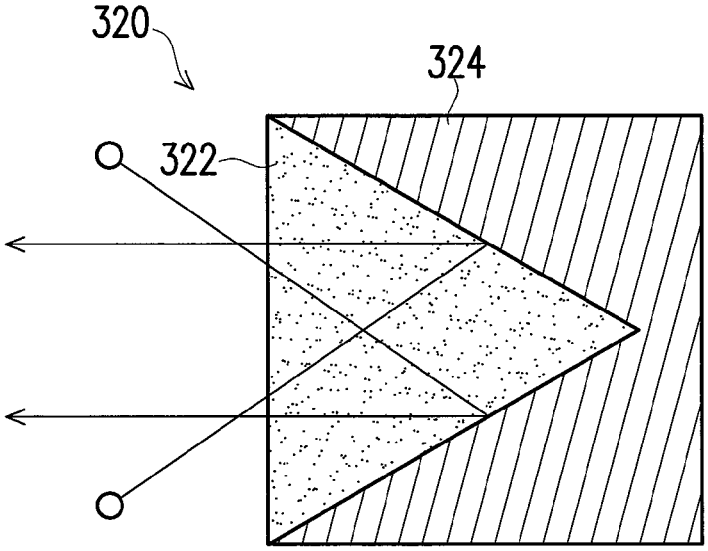
FIG. 3 is a schematic view illustrating an optical assembly according to another embodiment of the invention.

FIG. 3 is a schematic view illustrating an optical assembly according to another embodiment of the invention. Please refer to FIG. 3. The main difference between an optical assembly 320 of FIG. 3 and the optical assembly 120 of FIG. 1A lies in that a reflector 324 of the optical assembly 320 of FIG. 3 is a block-shaped structure. A wavelength converting device 322 is embedded in the reflector 324 and exposes at least a portion of the region of at least one surface of the wavelength converting device 322. In the embodiment, the wavelength converting device 322 is illustrated as a tetrahedron as an example. The reflector 324 covers three surfaces and exposes the remaining one surface of the wavelength converting device 322. Likewise, the light may enter the wavelength converting device 322 from the surface of the wavelength converting device 322 not being covered by the reflector 324, and the light leaves the wavelength converting device 322 from the same surface after being reflected by the reflector 324, which may also achieve the effect of converting light wavelength and modifying light profile.

Figure 4:
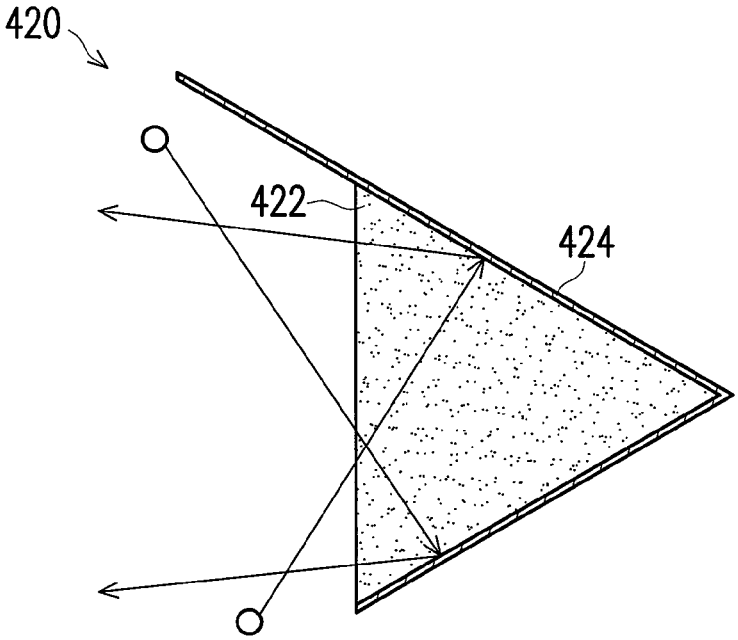
FIG. 4 is a schematic view illustrating an optical assembly according to another embodiment of the invention.

FIG. 4 is a schematic view illustrating an optical assembly according to another embodiment of the invention. Please refer to FIG. 4. The main difference between an optical assembly 420 of FIG. 4 and the optical assembly 120 of FIG. 1A lines in that, in FIG. 1A, the areas of different surfaces of the reflector 124 are the same, and the respective areas of different surfaces of the reflector 124 are equivalent to the area of the covered surface of the wavelength converting device 124. In FIG. 4, the areas of different surfaces of the reflector 424 of the optical assembly 420 are different, and the respective areas of different surfaces of the reflector 424 are greater than the area of the covered surface of the wavelength converting device 422.

Certainly, in other embodiments, it may be that the areas of different surfaces of the reflector 424 are different, and the area of one of the surfaces of the reflector 424 is greater than the area of the covered surface of the wavelength converting device 422. The area of another surface of the reflector 424 is equivalent to the area of the covered surface of the wavelength converting device 422. Alternatively, the areas of different surfaces of the reflector 424 are the same, and the respective areas of different surfaces of the reflector 424 are greater than the area of covered surface of the wavelength converting device 422.

No matter what sizes of the surfaces that the reflector 424 and the wavelength converting device 422 have as mentioned in all the above cases, the light may enter the wavelength converting device 422 from the surface of the wavelength converting device 422 not being covered by the reflector 424, and the light leaves the wavelength converting device 422 after being reflected by the reflector 424, thereby achieving the effect of converting light wavelength and modifying light profile.

Figure 5:
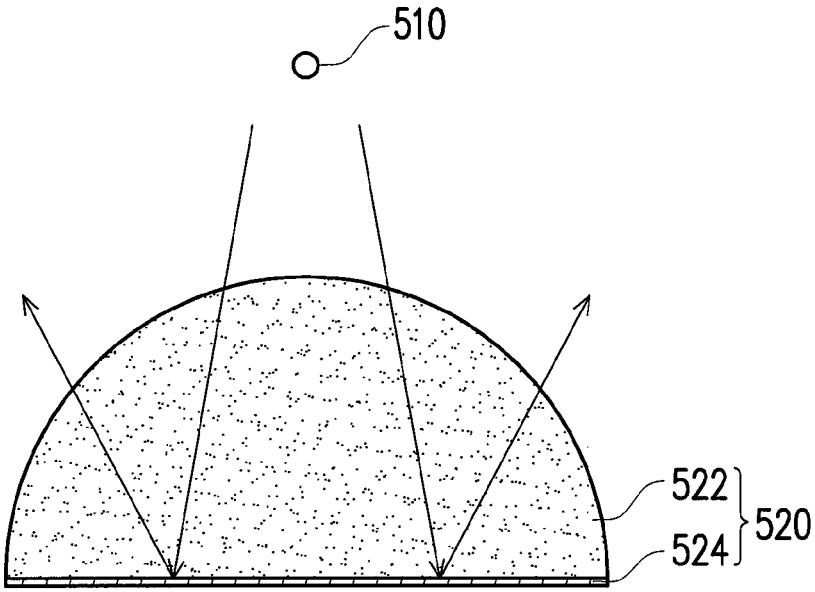
FIG. 5 is a schematic view illustrating an optical assembly according to another embodiment of the invention.

FIG. 5 is a schematic view illustrating an optical assembly according to another embodiment of the invention. Please refer to FIG. 5. The main difference between an optical assembly 520 of FIG. 5 and the optical assembly 120 of FIG. 1A lies in that, in FIG. 1A, the shape of the wavelength converting device 122 is a tetrahedron, whereas in FIG. 5 the shape of the wavelength converting device 522 is a hemisphere, and a reflector 524 is disposed on the circular plane of the hemisphere. The light emitted by the light source 510 that is spaced apart from the wavelength converting device 522 by a distance enters the wavelength converting device 522 from the hemispherical surface of the wavelength converting device 522, after being reflected by the reflector 524, the light leaves the wavelength converting device 522 from the hemispherical surface of the wavelength converting device 522.

Figure 6:
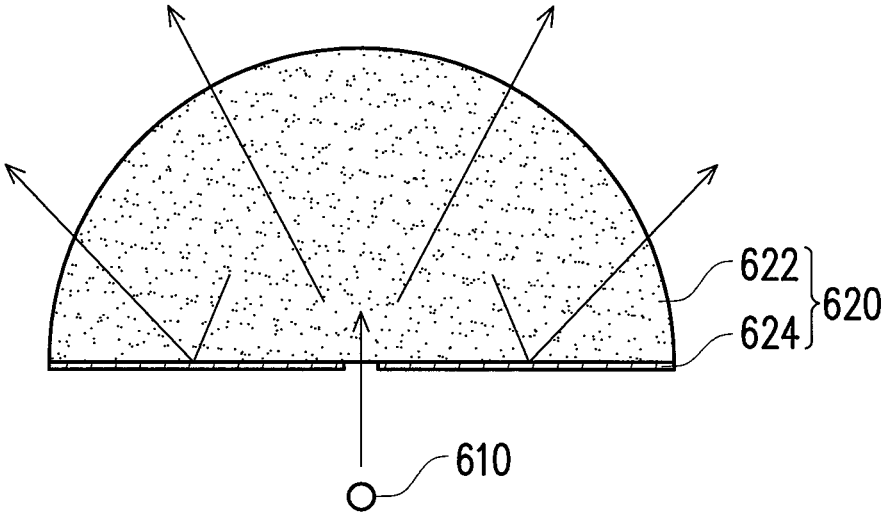
FIG. 6 is a schematic view illustrating an optical assembly according to another embodiment of the invention.

FIG. 6 is a schematic view illustrating an optical assembly according to another embodiment of the invention. Please refer to FIG. 6. The main difference between an optical assembly 620 of FIG. 6 and the optical assembly 520 of FIG. 5 lies in that, in FIG. 5, the reflector 524 completely covers the circular plane of the hemisphere, and the light source 510 is located at a position distant from the reflector 524. In FIG. 6, the reflector 624 covers most of the region of the circular plane of the hemisphere and exposes a little portion of the region. The light source 610 is disposed in the region close to the circular plane not being covered by the reflector 624, allowing the light emitted by the light source 610 to enter the wavelength converting device 622 from the region of the circular plane of the wavelength converting device 622 not being covered by the reflector 624. A portion of the light will be emitted directly from the hemispherical surface of the wavelength converting device 622 instead of through the reflector 624, and the other portion of the light will be emitted from the hemispherical surface of the wavelength converting device 622 after being reflected by the reflector 624.

Figure 7:
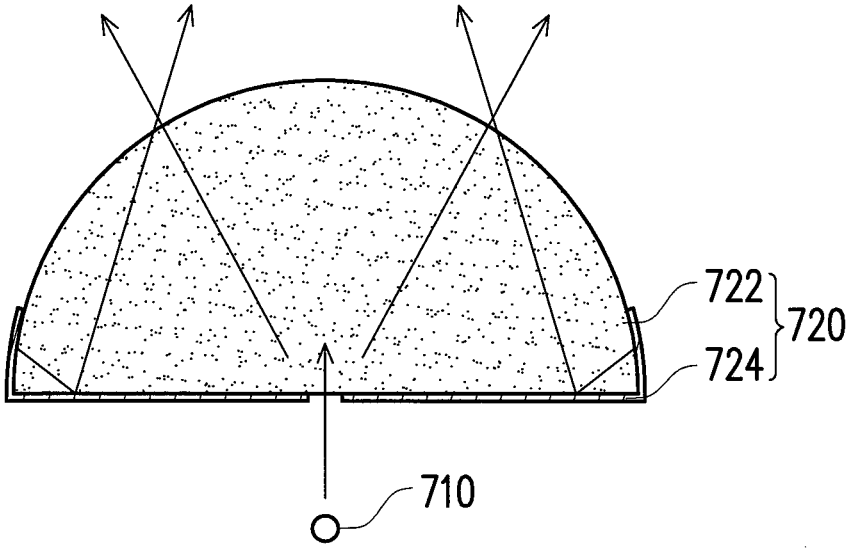
FIG. 7 is a schematic view illustrating an optical assembly according to another embodiment of the invention.

FIG. 7 is a schematic view illustrating an optical assembly according to another embodiment of the invention. Please refer to FIG. 7. The main difference between an optical assembly 720 of FIG. 7 and the optical assembly 620 of FIG. 6 lies in that the reflector 724 further covers a partial portion of the hemispherical surface of the wavelength converting device 722; specifically, the reflector 724 not only covers most of the region of the circular plane of the wavelength converting device 722, but also extends toward the hemispherical surface from the circular plane to cover the region of the hemisphere close to the circular plane. Such configuration may increase the area of the reflector 724, allowing a greater portion of the light that enters the wavelength converting device 722 to be transmitted back and forth within the wavelength converting device 722 after being reflected by the reflector 724, thereby allowing more light to achieve the function of converting wavelength.

Based on the above, in the invention, a designer may make the light emitted by the light source positioned outside the optical assembly to enter or leave the wavelength converting device from a specific portion of the wavelength converting device by choosing a wavelength converting device with a suitable shape and selecting which surface of the wavelength converting device is to be covered and exposed by the reflector, so as to allow the light to achieve the effect of converting the wavelength and changing light profile.

Although the invention has been disclosed by the above embodiments, the embodiments are not intended to limit the invention. It will be apparent to those skilled in the art that various modifications and variations can be made to the structure of the invention without departing from the scope or spirit of the invention. Therefore, the protecting range of the invention falls in the appended claims.

What is claimed is:

1. An optical assembly adaptable for being disposed at a light path of a light emitted by at least a light source and spaced apart from the at least one light source by a distance, comprising:

a wavelength converting device formed to be a spatial structure, wherein the wavelength converting device consists of a cured paste doped with phosphor; and a reflector directly covering and contacting a portion of the wavelength converting device and exposing at least a portion of a region of at least a surface of the wavelength converting device, wherein the light emitted by the at least one light source enters and leaves the wavelength converting device from a region of the wavelength converting device not being covered by the reflector, and the reflector directly covers and contacts a partial region of the same surface of the wavelength converting device which the light emitted by the at least one light source enters.

2. The optical assembly according to claim 1, wherein shapes of the spatial structure comprise a pyramid, a cone, a column or a hemisphere.

3. The optical assembly according to claim 1, wherein the at least one surface of the wavelength converting device not being covered by the reflector is a single surface, and the light emitted by the at least one light source enters and leaves the wavelength converting device from the single surface of the wavelength converting device.

4. The optical assembly according to claim 1, wherein the at least one surface of the wavelength converting device not being covered by the reflector comprises at least two surfaces, and the light emitted by the at least one light source enters and leaves the wavelength converting device respectively from the at least two surfaces of the wavelength converting device.

5. The optical assembly according to claim 1, wherein the reflector is a reflecting layer coated or adhered to a portion of the surface of the wavelength converting device.

6. The optical assembly according to claim 1, wherein the reflector is a block-shaped structure, and the wavelength converting device is embedded in the reflector and exposes the at least one portion of the region of the at least one surface of the wavelength converting device.

7. An optical module, comprising:

at least one light source;

an optical assembly located at a light path of a light emitted by the at least one light source and spaced apart from the at least one light source by a distance, the optical assembly comprising:

a wavelength converting device formed to be a spatial structure, wherein the wavelength converting device consists of a cured paste doped with phosphor; and a reflector directly covering and contacting a portion of the wavelength converting device and exposing at least a portion of a region of at least a surface of the wavelength converting device, wherein the light emitted by the at least one light source enters and leaves the wavelength converting device from a region of the wavelength converting device not being covered by the reflector, and the reflector directly covers and contacts a partial region of the same surface of the wavelength converting device which the light emitted by the at least one light source enters.

8. The optical module according to claim 7, wherein the at least one light source is a laser light source.

* * * * *